US011248298B2

(12) United States Patent
Li et al.

(10) Patent No.: US 11,248,298 B2
(45) Date of Patent: Feb. 15, 2022

(54) CHROMIUM-FREE SURFACE-TREATED TINPLATE, PRODUCTION METHOD AND SURFACE TREATING AGENT THEREFOR

(71) Applicant: BAOSHAN IRON & STEEL CO., LTD., Shanghai (CN)

(72) Inventors: Peng Li, Shanghai (CN); Renyun Yan, Shanghai (CN); Junsheng Wei, Shanghai (CN); Binghu Li, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 596 days.

(21) Appl. No.: 15/779,246

(22) PCT Filed: Nov. 29, 2016

(86) PCT No.: PCT/CN2016/107673
§ 371 (c)(1),
(2) Date: May 25, 2018

(87) PCT Pub. No.: WO2017/092648
PCT Pub. Date: Jun. 8, 2017

(65) Prior Publication Data

US 2018/0347051 A1 Dec. 6, 2018

(30) Foreign Application Priority Data

Nov. 30, 2015 (CN) ..... 201510854283.0

(51) Int. Cl.
*C23C 22/40* (2006.01)
*C23C 22/76* (2006.01)
*C23C 22/78* (2006.01)

(52) U.S. Cl.
CPC ..... *C23C 22/40* (2013.01); *C23C 22/76* (2013.01); *C23C 22/78* (2013.01); *C23C 2222/20* (2013.01)

(58) Field of Classification Search
CPC ..... C23C 22/40
USPC ..... 148/251
See application file for complete search history.

(56) References Cited

U.S. PATENT DOCUMENTS

| | | | | |
|---|---|---|---|---|
| 5,607,521 | A | 3/1997 | Bech-Nielsen et al. | |
| 6,180,177 | B1 | 1/2001 | Nagashima et al. | |
| 2005/0205166 | A1 | 9/2005 | Specht et al. | |
| 2015/0361572 | A1* | 12/2015 | Zhao | B05D 1/28 428/621 |

FOREIGN PATENT DOCUMENTS

| | | | | |
|---|---|---|---|---|
| CN | 1614089 | | 5/2005 | |
| CN | 1614089 | A | 5/2005 | |
| CN | 101560655 | A | 10/2009 | |
| CN | 102378828 | | 3/2012 | |
| CN | 102639750 | | 8/2012 | |
| CN | 103046040 | | 4/2013 | |
| CN | 103805977 | | 5/2014 | |
| CN | 103946421 | | 7/2014 | |
| CN | 103946421 | A | 7/2014 | |
| CN | 104144782 | | 11/2014 | |
| CN | 104357819 | | 2/2015 | |
| CN | 105331966 | | 2/2016 | |
| CN | 105331966 | A | 2/2016 | |
| EP | 1484174 | | 12/2004 | |
| EP | 2458031 | | 5/2012 | |
| JP | 2004183015 | A * | 7/2004 | C23C 22/42 |
| JP | 2007224361 | | 9/2007 | |
| JP | 2007224361 | A | 9/2007 | |
| KR | 20020041028 | B1 * | 6/2002 | |
| WO | 2004050581 | A | 6/2004 | |
| WO | 2004050581 | A2 | 6/2004 | |
| WO | WO-2007031276 | A1 * | 3/2007 | C09D 183/14 |
| WO | 2014117609 | | 8/2014 | |

OTHER PUBLICATIONS

Translation WO-2007031276-A1 (Year: 2007).*
Translation for published application KR20020041028 (original document, in Korean) using published Korean patent KR-100466418-B1 (English translation) (Year: 2005).*
Translation JP-2004183015-A (Year: 2004).*
Search Report and Written Opinion for Singapore Patent Application 11201803648X dated Sep. 2, 2019.
PCT/CN2016/107673 International Search Report and Written Opinion dated Feb. 21, 2-17.
European Search Report dated Sep. 2, 2019 for European Patent Application No. 16869958.5.
1st Office Action dated Aug. 23, 2017 for Chinese Patent Application No. 201510854283.0, along with the Machine translation.
European Search Report dated Feb. 16, 2021 for European Patent Application No. 16869958.5.
(Continued)

*Primary Examiner* — Coris Fung
*Assistant Examiner* — Danielle Carda
(74) *Attorney, Agent, or Firm* — Lei Fang; Smith Tempel Blaha LLC

(57) ABSTRACT

Provided are a chromium-free surface-treated tinplate, a production method and a surface treating agent thereof. By coating, on the surface of a tinplate, an environmentally friendly aqueous surface treating agent containing 0.1-5 wt % of a zinc salt, 0.1-5 wt % of a zirconium salt and/or a molybdenum salt and 5-30 wt % of siloxane or polysiloxane, a layer of chromium-free passivation film having uniform and dense ingredients and a good performance and being stable is formed on the surface of a tin layer. The passivation film contains 0.1-20 mg/m$^2$ of zinc, 0.1-20 mg/m$^2$ of zirconium and/or molybdenum and 0.5-100 mg/m$^2$ silicon. The passivation film can impart an excellent surface stability, corrosion resistance and paint film adhesion performance to the surface of the tinplate; in addition, contact with food is safe. The tinplate is comparable to chromium passivation in performance, and the production process thereof does not use a chromate, so that a truly green production process of a tinplate is achieved, complying with the requirements of increasingly strict environmental protection laws and regulations.

12 Claims, No Drawings

(56) References Cited

OTHER PUBLICATIONS

Office Action dated Mar. 22, 2021 for Malaysia Patent Application No. 2018701922.
Search Report dated Mar. 22, 2021 for Malaysia Patent Application No. 2018701922.

* cited by examiner

CHROMIUM-FREE SURFACE-TREATED TINPLATE, PRODUCTION METHOD AND SURFACE TREATING AGENT THEREFOR

CROSS-REFERENCE TO RELATED APPLICATIONS

This application is a 371 U.S. National Phase of PCT International Application No. PCT/CN2016/107673 filed on Nov. 29, 2016, which claims benefit and priority to Chinese patent application No. 201510854283.0, filed on Nov. 30, 2015. Both of the above-referenced applications are incorporated by reference herein in their entirety.

TECHNICAL FIELD

The disclosure pertains to the tinplate technical field, particularly to a chromium-free surface-treated tinplate, a method for producing the same, and a surface treating agent thereof.

BACKGROUND OF INVENTION

Tinplate, also known as galvanized iron, is a common metallic package material, used widely for packing food, beverage, tea, confectionery, chemicals, etc. Tinplate package has the advantages of beautiful appearance, good hermeticity, high strength, long shelf life, etc. Packaged food or beverage can maintain its original food flavor to the largest possible extent for a long time. In addition to package material, tinplate is also sometimes used in electronic devices or household appliance components. Hence, it's used in wide fields.

Tin on tinplate surface is a metal susceptible to oxidation by air. The oxide formed by oxidation of tin degrades processability and usability of tinplate. Thus, tinplate surface is passivated in traditional production of tinplate.

Passivation in tinplate production generally adopts an electrolytic passivation process in which immersion in a chromate solution is used. Chromium in the solution is electrolytically reduced to a trivalent chromium compound or metallic chromium deposited on tinplate surface to form a dense layer of chromium passivation film. Tinplate treated thereby exhibits superior performances, environmental friendliness, no toxicity, and safety to food contact. However, a chromate is used in tinplate production involving passivation. Due to increasingly strict environmental protection, use of a chromate is more and more restricted. Therefore, chromium-free surface treatment in tinplate production represents a megatrend of development of tinplate production technology.

The current tinplate surface treatment employs a production technology of chromate electrolytic passivation, wherein a steel plate with tinplated surface is immersed in a chromium-containing treating solution for cathode electrolytic treatment, so that a layer of chromium-containing passivation film is formed on the tinplate surface. This passivation film is consisting of a trivalent chromium compound and metallic chromium, exhibiting superior performances, environmental friendliness, no toxicity, and safety to food contact. However, this production method of tinplate involving passivation has a disadvantage that a hexavalent chromate is used. Production and use of a chromate threatens environmental safety, and cost of treatment for environmental protection is high.

Nowadays, production and use of chromates are confined more and more strictly in the world, which requires chromium-free production of tinplate. Therefore, it's necessary to develop a production method comprising treatment of tinplate surface without use of chromium, wherein a novel environmentally friendly surface treating agent is used in the production process, and the chromium-free surface-treated tinplate still ensures excellent processability and usability. With respect to chromium-free surface treatment in tinplate production, a good number of related research achievements have been published at home and abroad, as described below particularly.

In respect of related technology for chromium-free surface treatment of tinplate, Chinese Patent CN01806287.3 discloses a surface treating solution comprising phosphoric acid ions, tin ions and a silane coupling agent, and Chinese Patent CN200880103264.2 discloses a chromium-free surface treating method using a silane coupling agent as a main component for a coating on a tinplate surface. The techniques disclosed by the above two patents can afford good tinplate surface stability and paint film adhesion, but corrosion resistance is apparently inferior as compared with chromium passivation.

Chinese Patent CN01116679.7 discloses a surface treating solution comprising a silane coupling agent and/or its hydrolytic condensation product, dispersed solid silica particles and zirconium and/or titanium ions or compounds, and a water soluble acrylic resin; Chinese Patent CN200580028595.0 discloses a chromium-free treating solution and a treating method involving an inorganic surface treating layer comprising O, F and at least one of Ti, Zr or Al, and an organic surface treating layer comprising a silane coupling agent or a water soluble phenolic compound; Chinese Patent CN201210445665.4 discloses a chromium-free passivation solution for treating a tinplate, comprising substantially the following components: an inorganic compound comprising at least one of silicon, titanium and zirconium, a metallic compound comprising at least one of aluminum, vanadium, manganese, cobalt, nickel and molybdenum, and a water soluble resin; Chinese Patent CN201280066604.5 discloses a passivation method using a chromium-free passivation treating agent comprising titanium and/or zirconium to coat a tinplate surface and form a film by baking, wherein the passivation solution comprises a water soluble resin. The above technical disclosures are virtually close to each other, considered to be able to achieve good paint film adhesion and corrosion resistance. However, the corrosion resistance still cannot reach the level achieved by chromium passivation. Moreover, certain components in these surface treating agents have some toxicity or potential toxicity. Hence, tinplates produced thereby have some safety risk in food contact, and thus they can hardly be commercialized for real applications.

Chinese Patent CN201410650819.2 discloses a chromium-free surface treating agent for a tinplate, comprising ions of titanium, silicon, aluminum, manganese, nickel and the like, and phosphate group. This passivation solution system is complicated in composition, and it's difficult to form on a tinplate surface a passivation film having a uniform composition, good performances and stability. In addition, the passivation solution comprises fluorine, leading to poor environmental friendliness. This technique is also considerably difficult to be put into successful practice.

SUMMARY OF THE INVENTION

An object of the disclosure is to provide a chromium-free surface-treated tinplate, a production method and a surface treating agent therefore, wherein there is formed on a tin layer surface of the tinplate a layer of chromium-free passivation film having a uniform and dense composition, good performances and good stability, wherein the passivation film can provide the tinplate surface with excellent surface stability, corrosion resistance and paint film adhesion, and is safe for food contact. This tinplate is comparable with a chromium-passivated tinplate in performances. No chromate is used in the production process, so that a truly green process for producing a tinplate is achieved, complying with the requirements of increasingly strict environmental protection laws and regulations.

To achieve the above object, the technical solution of the disclosure is as follows:

A chromium-free surface-treated tinplate is provided, wherein a surface of a tin layer is covered with a chromium-free passivation film, wherein the chromium-free passivation film comprises 0.1-20 mg/m$^2$ of zinc, 0.1-20 mg/m$^2$ of zirconium and/or molybdenum and 0.5-100 mg/m$^2$ silicon.

Further, the zinc in the passivation film is from a zinc salt; the zirconium in the passivation film is from a zirconium salt; the molybdenum in the passivation film is from a molybdenum salt; and the silicon in the passivation film is from an organosiloxane or polysiloxane.

Preferably, the zinc salt is selected from at least one of zinc sulfate, zinc acetate, zinc nitrate, zinc gluconate, and zinc methionine; the zirconium salt is selected from at least one of zirconium oxysulfate, zirconium oxynitrate, ammonium zirconium carbonate, tetrabutyl zirconate, and zirconium isopropoxide; the molybdenum salt is selected from at least one of molybdic acid, ammonium molybdate, sodium molybdate, and potassium molybdate; and the organosiloxane or polysiloxane is obtained by hydrolysis of an epoxy silane coupling agent.

An aqueous surface treating agent for chromium-free surface treatment of a tinplate, comprises 0.1-5 wt % of a zinc salt, 0.1-5 wt % of a zirconium salt and/or a molybdenum salt, 5-30 wt % of an organosiloxane or polysiloxane and a balance of water, wherein the aqueous surface treating agent has a pH of 3-6.

Further, the aqueous surface treating agent further comprises at least one of a reinforcing agent, a wetting agent and an organic acid regulator, wherein the reinforcing agent has a content of 0.1-2 wt %, the wetting agent has a content of 0.1-2 wt %, and the organic acid regulator has a content of 0.1-1 wt %.

Still further, in the aqueous surface treating agent, the reinforcing agent is polyvinyl alcohol, the wetting agent is polyethylene glycol, and the organic acid regulator is selected from citric acid, acetic acid or fumaric acid.

Preferably, the zinc salt is selected from at least one of zinc sulfate, zinc acetate, zinc nitrate, zinc gluconate, and zinc methionine; the zirconium salt is selected from at least one of zirconium oxysulfate, zirconium oxynitrate, ammonium zirconium carbonate, tetrabutyl zirconate, and zirconium isopropoxide; the molybdenum salt is selected from at least one of molybdic acid, ammonium molybdate, sodium molybdate, and potassium molybdate; and the organosiloxane or polysiloxane is obtained by hydrolysis of an epoxy silane coupling agent.

The passivation film of the disclosure exhibits good surface stability. The tin oxide in the surface does not increase notably even after long-term storage or hot-air baking during processing. The passivation film shows good corrosion resistance, sulfide staining resistance and acid resistance. After coating, the paint film has good adhesion, even better than the case of chromium passivation under certain conditions. Furthermore, the passivation film is free of heavy metals and organic ingredients potentially toxic to human body. It's non-toxic in contact with food, and it's environmentally friendly.

The passivation film on the surface of the surface-treated tinplate of the disclosure comprises zinc, zirconium and/or molybdenum, as well as silicon, wherein zinc, zirconium and/or molybdenum, particularly zinc, bond with active functional groups in the passivation film, and distribute dispersively, uniformly in the passivation film, leading to significantly improved corrosion resistance of the passivation film. This combined use yields effects comparable to chromium passivation.

The zirconium, zinc and molybdenum salts in the environmentally friendly aqueous surface treating agent of the disclosure provide film forming ingredients for the passivation film, improving the passivation film's corrosion resistance such as resistance to sulfur, acid, etc. The organosiloxane or polysiloxane is obtained by hydrolysis of an epoxy silane coupling agent, providing a further film forming ingredient for the passivation film, which acts a framework of the passivation film. The groups of the organosiloxane or polysiloxane are able to bond well with zinc, zirconium and/or molybdenum, sealing the tin layer very well. The epoxy functional group in the organosiloxane or polysiloxane plays an important role in ensuring paint film adhesion after coating.

Polyvinyl alcohol in the aqueous surface treating agent of the disclosure acts as a reinforcing agent. It can improve obdurability of the passivation film structure, so that the passivation film is not susceptible to microcracking, and the sealing effect is promoted. As a wetting agent, polyethylene glycol also has a dispersing function for improving usability of the surface treating agent, so that the tinplate surface can be wetted better, and the treating agent is more ready to be spread uniformly. The function of the organic acid regulator is pH adjustment of the surface treating agent.

The surface treating agent of the disclosure is an aqueous treating agent having a pH of 3-6, free of chromates, fluorine and phosphorus. Its composition is non-toxic and environmentally friendly. The aqueous surface treating agent can be coated directly on a tinplate surface or immersed prior to coating on a tinplate surface, followed by drying to form a film.

The tinplate surface-treated with the surface treating agent of the disclosure shows good surface stability, paint film adhesion and corrosion resistance, and it's safe to contact food. The tinplate is useful for food cans, beverage cans, chemical cans, electronic devices, etc.

The disclosure further provides a method for producing a chromium-free surface-treated tinplate, comprising the following steps:

1) electrotinning process and soft melting treatment wherein a phenolsulfonic acid (PSA) tin plating or methanesulfonic acid (MSA) tin plating process is used as the electrotinning process, wherein a tin layer is subjected to the soft melting treatment after the tin plating is finished;

2) washing wherein, after the soft melting, a surface of a tinplate is washed by immersing the tinplate in distilled water or sprinkling distilled water to the surface of the tinplate for washing, and redundant water on the surface of the tinplate is removed using a wringing roll;

3) coating wherein the aqueous surface treating agent is coated on the surface of the tinplate by spraying or rolling, and a wringing roll is used to remove a redundant aqueous surface treating agent, so that a liquid film of the aqueous surface treating agent is coated uniformly;

4) drying wherein the surface of the tinplate coated with the aqueous surface treating agent is dried in hot air, wherein a temperature of the hot air is controlled between 80-120° C., and a drying time is 0.2-2 seconds, wherein the surface treating agent is dried into a film, so that a chromium-free surface-treated tinplate is obtained.

Further, the method further comprises an immersing step prior to the coating step of step 3), wherein the immersing step comprises immersing the tinplate in the aqueous surface treating agent for 0.2-5 seconds.

In the method for producing a chromium-free surface-treated tinplate according to the disclosure, the tinplate surface is washed after soft melting. The purpose of washing is to remove impurities and dirt from the surface to guarantee cleanness of the tinplate surface. The immersion prior to the coating pretreats the tinplate surface to activate the tinplate surface, so that the passivation film is more ready to form, and the uniformity of the film distribution can be improved.

According to a conventional process, a tinplate needs cathode electrolytic treatment in electrolytic tanks, wherein two or more electrolytic tanks are generally needed. In addition, 2-3 cleaning tanks are also needed. Meanwhile, other auxiliary devices such as anodes, conductor rolls and wringing rolls and the like are also necessary.

The method for producing a surface-treated tinplate according to the disclosure is simple, shortening the conventional process flow. The aqueous surface treating agent utilized is free of any chromate, and thus a process for electrolytic treatment of a chromate is omitted. The process of the disclosure is simpler and more reliable. There is little or no waste liquid to be disposed. The comprehensive cost for operating the process, including treatment for environmental protection, is low. The process can be put into operation just after modest modification of a conventional tinplate production line.

The disclosure has the following beneficial effects in comparison with the prior art:

1) The surface-treated tinplate of the disclosure has good surface stability, corrosion resistance, sulfide staining resistance and acid resistance. The overall performances of the surface are comparable with those of a chromium passivated surface. The surface of the disclosure is cleaner with no smudge. After coating, the paint film has good adhesion, even better than the case of chromium passivation under certain conditions. The surface is free of heavy metals and organic ingredients potentially toxic to human body. It's non-toxic in contact with food, and it's environmentally friendly.

2) The surface treating agent of the disclosure is free of environmentally undesirable chromates, potentially toxic fluorine, and phosphates that tend to cause environmental eutrophication. The ingredients of the treating agent are environmentally friendly, non-toxic, biodegradable or naturally degradable. The waste liquid from the production can be disposed in a simple way. It's environmentally friendly, and the treatment cost for environmental protection is low.

3) The method for producing a surface-treated tinplate according to the disclosure is simple and environmentally friendly, and has good process stability and low cost. This method for producing a surface-tinned plate realizes thorough friendliness to environment from the production of the tinplate to the final product. This method conforms to the technical development trend for production of tinplate, and meets the requirements of currently strict environmental protection laws and regulations. It exhibits favorable economic effectiveness and significant social effectiveness, and is highly valuable for commercial promotion and application.

DETAILED DESCRIPTION OF THE INVENTION

The disclosure is further illustrated with reference to the following specific Examples.

Table 1 lists the ingredients in the aqueous surface treating agents for the chromium-free passivated tinplates in Examples 1-10 and the treatment process according to the disclosure, wherein the contents of the various ingredients in the surface treating agents are based on mass percentage (wt %), and water makes up the balance; wherein the treating method means direct coating of an aqueous surface treating agent, or immersion plus subsequent coating, and the treating time means a total amount of time needed from immersion+coating or direct coating to completion of baking.

The method for producing a chromium-free surface-treated tinplate according to the disclosure comprises the following steps:

1) a black sheet for a tinplate was subjected to an electrotinning process and then soft melting treatment of the tin layer, wherein a phenolsulfonic acid tin plating or methanesulfonic acid tin plating process was used as the electrotinning process, wherein the tin layer was subjected to the soft melting treatment after the tin plating was finished;

2) after the soft melting, the tinplate surface was washed by immersing the tinplate in distilled water or sprinkling distilled water to the tinplate surface for washing, and the redundant water on the tinplate surface was removed using a wringing roll;

3) the tinplates in Examples 1-5, 7, 9-10 were immersed in the corresponding aqueous surface treating agents for 0.2-5 seconds;

4) the aqueous surface treating agents of Examples 1-10 were coated onto the immersed or un-immersed tinplate surfaces by spraying or rolling, and a wringing roll was used to wring out the redundant aqueous surface treating agents, such that the liquid films of the aqueous surface treating agents had uniform thicknesses, wherein the film thickness could be adjusted depending on the spray amount or coating amount, and the pressure of the wringing roll;

5) the tinplate surfaces coated with the surface treating agents were dried in hot air, wherein the temperature of the hot air was controlled between 80-120° C., and the drying time was 0.2-2 seconds, wherein the aqueous surface treating agents were dried into films, so that chromium-free surface-treated tinplates were obtained.

After chromium-free passivated tinplate samples were prepared according to Examples 1-10 of the disclosure, the resulting chromium-free surface-treated tinplates were evaluated for baking discoloration resistance, paint film adhesion and corrosion resistance. The evaluation results are shown in Table 2, compared with a chromium passivated comparative sample, wherein the comparative sample was a conventional tinplate sample treated by chromate electrolytic passivation, wherein the chromium content in the passivation film of the comparative sample was 5 $mg/m^2$.

The evaluation items are as follows:

1) Baking discoloration resistance

Working conditions during coating of a tinplate were simulated, wherein the surface-treated tinplates obtained in the Examples were baked with hot air at 200° C. for 60 minutes. The tinplate surfaces were observed to see if baking discoloration occurred, so as to investigate their baking discoloration resistance.

2) Paint film adhesion

The method for evaluating paint film adhesion made reference to the method for evaluating paint film adhesion adopted in QB/T 2763-2006 "Coating of Tin (or Chromium) Plated Thin Steel Plates". A commercially available epoxy phenolic coating was used as a coating to coat the tinplate surfaces treated with the passivating agents of the disclosure. The dry film weight of the tinplate coating was 6-8 $g/m^2$. After the paint film surface was scratched and peeled with adhesive tape, the degree to which the paint film was detached from the surface was inspected. The paint film adhesion was evaluated based on the area of the paint film that fell off, and compared with the chromium passivated sample.

3) Sulfide staining resistance

The method for evaluating the sulfide staining resistance made reference to the method for evaluating the sulfide staining resistance in QB/T 2763-2006 "Coating of Tin (or Chromium) Plated Thin Steel Plates". The formation of sulfide stains on the surfaces of the samples treated with the passivating agents of the disclosure was observed based on the testing results, and a comparison was made with the chromium passivated sample.

4) Acid resistance

The method for evaluating the acid resistance made reference to the method for evaluating the acid resistance in QB/T 2763-2006 "Coating of Tin (or Chromium) Plated Thin Steel Plates". The formation of acid stains on the surfaces of the samples treated with the passivating agents of the disclosure was observed based on the testing results, and a comparison was made with the chromium passivated sample.

As can be seen from Table 2, the tinplates made according to the method involving the chromium-free surface treatment of the disclosure have achieved performances comparable with those of the chromium passivated comparative sample in terms of baking discoloration resistance, paint film adhesion, sulfide staining resistance and acid resistance, among which the paint film adhesion and corrosion resistance are even better.

TABLE 1

| No. | Zn salt (wt %) | Mn salt (wt %) | Zr salt (wt %) | Organosiloxane or polysiloxane (wt %) | Polyvinyl alcohol (wt %) | pH | Treating method | Treating time (s) |
|---|---|---|---|---|---|---|---|---|
| Ex. 1 | 0.1 | 5 | — | 10 | 2 | 5 | Immersion + coating | 5 |
| Ex. 2 | 0.1 | — | 5 | 10 | 2 | 5 | Immersion + coating | 5 |
| Ex. 3 | 0.5 | 3 | — | 10 | 1 | 5 | Immersion + coating | 3 |
| Ex. 4 | 0.5 | — | 3 | 20 | 1 | 4 | Immersion + coating | 3 |
| Ex. 5 | 1 | 1 | 1 | 20 | 0.5 | 4 | Immersion + coating | 1 |
| Ex. 6 | 1 | 0.5 | 0.5 | 20 | 0.5 | 4 | Coating | 0.5 |
| Ex. 7 | 3 | 0.5 | — | 30 | 1 | 3 | Immersion + coating | 1 |
| Ex. 8 | 3 | — | 0.5 | 30 | 1 | 3 | Coating | 0.5 |
| Ex. 9 | 5 | 0.1 | — | 5 | 0.2 | 6 | Immersion + coating | 2 |
| Ex. 10 | 5 | — | 0.1 | 10 | 0.2 | 6 | Immersion + coating | 2 |

TABLE 2

| | Baking discoloration resistance | Paint film adhesion | Sulfide staining resistance | Acid resistance |
|---|---|---|---|---|
| Ex. 1 | ○ | ○ | ○ | ◎ |
| Ex. 2 | ○ | ○ | ○ | ○ |
| Ex. 3 | ○ | ○ | ○ | ○ |

TABLE 2-continued

| | Baking discoloration resistance | Paint film adhesion | Sulfide staining resistance | Acid resistance |
|---|---|---|---|---|
| Ex. 4 | ○ | ◎ | ◎ | ○ |
| Ex. 5 | ○ | ○ | ○ | ◎ |
| Ex. 6 | ○ | ◎ | ○ | ○ |
| Ex. 7 | ○ | ◎ | ◎ | ○ |
| Ex. 8 | ○ | ○ | ○ | ○ |
| Ex. 9 | ○ | ○ | ○ | ○ |
| Ex. 10 | ○ | ○ | ○ | ○ |
| Comparative Example | ○ | ○ | ○ | ○ |

Note:
◎—good performance, better than chromium passivation;
○—performance comparable with chromium passivation;
●—performance inferior to chromium passivation.

The invention claimed is:

1. A chromium-free surface-treated tinplate, wherein a chromium-free passivation film is formed on a surface of a tin layer, wherein the chromium-free passivation film comprises 0.1-20 $mg/m^2$ of zinc, 0.1-20 $mg/m^2$ of zirconium and/or molybdenum, and 0.5-100 $mg/m^2$ silicon, and wherein the chromium-free passivation film is also fluorine-free and phosphorus-free, wherein the zinc in the chromium-free passivation film is from a zinc salt, and the zinc salt is selected from the group consisting of zinc sulfate, zinc acetate, zinc nitrate, zinc gluconate, and zinc methionine; and the silicon in the chromium-free passivation film is from an organosiloxane or polysiloxane, and the organosiloxane or polysiloxane is obtained by hydrolysis of an epoxy silane coupling agent.

2. The chromium-free surface-treated tinplate of claim 1, wherein the zirconium in the chromium-free passivation film is from a zirconium salt; the molybdenum in the chromium-free passivation film is from a molybdenum salt.

3. The chromium-free surface-treated tinplate of claim 2, wherein the zirconium salt is selected from the group consisting of zirconium oxysulfate, zirconium oxynitrate, ammonium zirconium carbonate, tetrabutyl zirconate, and zirconium isopropoxide.

4. The chromium-free surface-treated tinplate of claim 2, wherein the molybdenum salt is selected from the group consisting of molybdic acid, ammonium molybdate, sodium molybdate, and potassium molybdate.

5. A method for producing the chromium-free surface-treated tinplate of claim 1, comprising:

a) electrotinning process and soft melting treatment, wherein a phenolsulfonic acid tin plating or methanesulfonic acid tin plating process is used as the electrotinning process, wherein the tin layer is subjected to the soft melting treatment after the phenolsulfonic acid tin plating or methanesulfonic acid tin plating process is finished;

b) washing, after the soft melting treatment, a surface of a tinplate by immersing the tinplate in water or spraying water to the surface of the tinplate, and removing redundant water on the surface of the tinplate using a wringing roll;

c) coating the surface of the tinplate by spraying or rolling an aqueous surface treating agent, and removing redundant aqueous surface treating agent with a wringing roll, wherein a liquid film of the aqueous surface treating agent is coated uniformly; and d) drying the surface of the tinplate coated with the aqueous surface treating agent in hot air, wherein a temperature of the hot air is controlled between 80-120° C., and a drying time is 0.2-2 seconds, and wherein the aqueous surface treating agent is dried into a film and the chromium-free surface-treated tinplate is obtained.

6. The method of claim 5, further comprising an immersing step prior to the coating step of step c), wherein the immersing step comprises immersing the tinplate in the aqueous surface treating agent for 0.2-5 seconds.

7. The method of claim 5, wherein the aqueous surface treating agent comprises 0.1-5 wt % of the zinc salt, 0.1-5 wt % of the zirconium salt and/or the molybdenum salt, 5-30 wt % of an organosiloxane or polysiloxane and a balance of water, wherein the aqueous surface treating agent has a pH of 3-6, and wherein the zinc salt is selected from the group consisting of the zinc sulfate, zinc acetate, zinc nitrate, zinc gluconate, and zinc methionine, and the organosiloxane or polysiloxane is obtained by the hydrolysis of the epoxy silane coupling agent.

8. The method of claim 7, wherein the aqueous surface treating agent further comprises at least one of a reinforcing agent, a wetting agent and an organic acid regulator, wherein the reinforcing agent has a content of 0.1-2 wt %, the wetting agent has a content of 0.1-2 wt %, and the organic acid regulator has a content of 0.1-1 wt %.

9. The method of claim 8, wherein the reinforcing agent is polyvinyl alcohol, and the wetting agent is polyethylene glycol.

10. The method of claim 8, wherein the organic acid regulator is selected from the group consisting of citric acid, acetic acid, and fumaric acid.

11. The method of claim 7, wherein the zirconium salt is selected from the group consisting of zirconium oxysulfate, zirconium oxynitrate, ammonium zirconium carbonate, tetrabutyl zirconate, and zirconium isopropoxide.

12. The method of claim 7, wherein the molybdenum salt is selected from the group consisting of molybdic acid, ammonium molybdate, sodium molybdate, and potassium molybdate.

* * * * *